US010672599B2

(12) United States Patent
Kitano

(10) Patent No.: US 10,672,599 B2
(45) Date of Patent: Jun. 2, 2020

(54) METHOD FOR SIMULTANEOUS MULTICOMPONENT ANALYSIS USING MASS SPECTROMETRY AND MASS SPECTROMETER

(71) Applicant: SHIMADZU CORPORATION, Kyoto-shi, Kyoto (JP)

(72) Inventor: Riki Kitano, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 16/687,921

(22) Filed: Nov. 19, 2019

(65) Prior Publication Data

US 2020/0083032 A1 Mar. 12, 2020

Related U.S. Application Data

(62) Division of application No. 15/874,087, filed on Jan. 18, 2018.

(51) Int. Cl.
*H01J 49/00* (2006.01)
*H01J 49/42* (2006.01)

(52) U.S. Cl.
CPC ..... *H01J 49/0027* (2013.01); *H01J 49/005* (2013.01); *H01J 49/009* (2013.01); *H01J 49/4215* (2013.01)

(58) Field of Classification Search
CPC .. H01J 49/0027; H01J 49/4215; H01J 49/005; H01J 49/009

(Continued)

(56) References Cited

U.S. PATENT DOCUMENTS

2013/0221214 A1 8/2013 Shiohama
2013/0297230 A1* 11/2013 Kawase ..... H01J 49/0036 702/32

FOREIGN PATENT DOCUMENTS

JP 2005-77094 A * 3/2005 ..... G01N 27/62
JP 2005077094 A 3/2005
JP 2013-234859 A 11/2013

OTHER PUBLICATIONS

"Application Data Sheet No. 98, GC-MS, Automatic Optimization of Transitions and Collision Energies", [online], Shimadzu Corporation, [accessed on Jul. 6, 2015, the Internet.

(Continued)

*Primary Examiner* — Michael Maskell
(74) *Attorney, Agent, or Firm* — Sughrue Mion, PLLC

(57) ABSTRACT

In a simultaneous multicomponent analysis for a number of target compounds, an MRM transition which does not give the highest signal intensity but gives a lower signal intensity is selected for a compound having a high measurement sensitivity or a compound having a high measurement target concentration. If the signal intensity is still high, the level of collision energy (CE) is changed from an optimum level. The MRM transition, CE level and other measurement conditions determined for each compound in this manner are stored in a compound-related information storage 41. In the process of preparing a control sequence for the simultaneous multicomponent analysis, the measurement conditions stored in the storage section 41 are used. The use of those conditions prevents the saturation of the signal for a high-concentration compound while ensuring a sufficiently high level of sensitivity for a low-concentration compound.

2 Claims, 5 Drawing Sheets

(58) Field of Classification Search
USPC ..... 250/281, 282
See application file for complete search history.

(56) References Cited

OTHER PUBLICATIONS

Communication dated Nov. 20, 2018, from Japanese Patent Office in counterpart application No. 2015-138334.

* cited by examiner

METHOD FOR SIMULTANEOUS MULTICOMPONENT ANALYSIS USING MASS SPECTROMETRY AND MASS SPECTROMETER

CROSS REFERENCE TO RELATED APPLICATIONS

This application is a Divisional of U.S. application Ser. No. 15/874,087, filed Jan. 18, 2018, the contents of all of which are incorporated herein by reference in their entirety.

TECHNICAL FIELD

The present invention relates to a method for a simultaneous multicomponent analysis for analyzing a number of compounds using a mass spectrometer, as well as a mass spectrometer for such a method, and more specifically, to an analyzing method and a mass spectrometer suitable for performing a simultaneous multicomponent analysis in a chromatograph mass spectrometer including a gas chromatograph (GC) or liquid chromatograph (LC) combined with a mass spectrometer (MS).

BACKGROUND ART

In recent years, simultaneous multicomponent analyses using gas chromatograph mass spectrometers (GC-MS) or liquid chromatograph mass spectrometers (LC-MS) have been utilized in various areas, such as the testing of residual agricultural chemicals in foods, the testing of contaminants in environmental water, or the testing of drugs and poisons. For example, in a simultaneous multicomponent analysis for several hundred or even more compounds, it is often the case that there are a plurality of compounds which cannot be sufficiently separated in a GC or LC. In such a case, a tandem mass spectrometer, such as a triple quadrupole mass spectrometer or Q-TOF mass spectrometer, is often used as the mass spectrometer to minimize the influences of other compounds, unwanted foreign substances or other components which are eluted in a temporally overlapped form.

Normally, in a simultaneous multicomponent analysis using a GC-MS or LC-MS including a tandem mass spectrometer, a combination of the mass-to-charge ratio of a precursor ion and that of a product ion for a multiple reaction monitoring (MRM) measurement, i.e. an MRM transition, is set as the measurement target ions for each target compound. For each point in time at which one target compound is introduced into the mass spectrometer (retention time in GC or LC), an MRM measurement under the MRM transition corresponding to the compound concerned is performed, and the signal intensity of a product ion originating from the same compound is detected.

To obtain a correct result in such an analysis, an appropriate MRM transition needs to be set for each compound. Additionally, in the case of a triple quadrupole mass spectrometer or Q-TOF mass spectrometer, in which the precursor ion is fragmented by collision induced dissociation within a collision cell, the collision energy (CE) also needs to be appropriately set as one of the MRM measurement conditions, since the dissociation efficiency changes with the amount of collision energy imparted to the precursor ion.

For example, as disclosed in Non Patent Literature 1 or other documents, there is a conventionally known mass spectrometer which has the function of searching for an optimum MRM transition for a compound for which the MRM transition is unknown, and then automatically searching for an optimum level of collision energy for the optimum MRM transition. The use of such a function makes it possible to automatically search for an optimum MRM transition and optimum level of collision energy for each of a plurality of target compounds, and conveniently prepare a control sequence for obtaining necessary data for the quantitative determination of each compound in the sample based on the search result.

In the aforementioned automatic search for the MRM transition and collision energy, the MRM transition and collision energy are normally determined so as to achieve the highest detection sensitivity, i.e. to maximize the signal intensity obtained with a detector, for each compound. Searching for the level of collision energy which maximizes the signal intensity is common practice also in the case where an operator manually determines an optimum level of the collision energy, e.g. as described in Patent Literature 1, without using the automatic search.

However, in the case of the simultaneous multicomponent analysis mentioned earlier, it may be impossible to perform an appropriate measurement if an MRM transition and collision energy which have been determined so as to achieve the highest detection sensitivity for each individual compound are used. For example, in the testing of residual agricultural chemicals based on the "Positive List" (which is used in Japan to control foods containing residual agricultural chemicals), the measurement target concentration may significantly vary depending on the target compound, or the signal intensity may significantly vary depending on the target compound even when the component concentration in the sample is the same. In such a case, if the measurement conditions other than the MRM transition and collision energy are set so that a compound having a low signal intensity or low measurement target concentration will be detected with a sufficient level of sensitivity, the signal in the detector may become saturated for a compound which yields a high signal intensity or a compound which has a high measurement target concentration. Conversely, if the measurement conditions other than the MRM transition and collision energy are set so that a compound having a high signal intensity or low measurement target concentration will be detected with a sufficient level of sensitivity, the signal may become too low for a compound which yields a low intensity of signal or a compound which has a low measurement target concentration, making it impossible to accurately determine the quantity of the compound.

To avoid such a situation, in a conventional simultaneous multicomponent analysis, the large number of target compounds are divided into groups depending on the difference in their signal intensity or the difference in their measurement target concentration. Appropriate measurement conditions are set for each group, and the measurement is repeatedly performed, with the sample injected multiple times. However, a measurement divided into multiple times in this manner requires a correspondingly greater amount of sample. The consumption of the mobile phase used in a GC or LC (carrier gas for GC, or eluant for LC) also increases. Furthermore, the period of time for the measurement naturally increases, which lowers the throughput of the analysis as well as increases the operation cost.

CITATION LIST

Patent Literature

Patent Literature 1: JP 2013-234859 A

Non Patent Literature

Non Patent Literature 1: "Application Data Sheet No. 98, GC-MS, Automatic Optimization of Transitions and Collision Energies", [online], Shimadzu Corporation, [accessed on Jul. 6, 2015, the Internet

SUMMARY OF INVENTION

Technical Problem

The present invention has been developed in view of the previously described problem. Its objective is to provide a method for a simultaneous multicomponent analysis using mass spectrometry, as well as a mass spectrometer used for such a method, which enable a high-sensitivity measurement for trace compounds while avoiding the saturation of the signal for high-concentration compounds in a simultaneous multicomponent analysis even when there are a large number of compounds whose quantities need to be individually determined and those compounds significantly vary in measurement target concentration and/or yield significantly different levels of signal intensity.

Solution to Problem

The first mode of the method for a simultaneous multicomponent analysis according to the present invention developed for solving the previously described problem is a method for a simultaneous multicomponent analysis in which an SIM measurement or MRM measurement is performed for each of a plurality of known target compounds in a sample using a mass spectrometer, and the quantity of each of the compounds is determined based on the result of the measurement. In this mode of the method, a mass-to-charge ratio to be monitored in the SIM measurement or an MRM transition to be monitored in the MRM measurement, which is one of the measurement conditions, is determined as follows: for a target compound having a comparatively high measurement target concentration or comparatively high measurement sensitivity, a mass-to-charge ratio or MRM transition which yields a comparatively low signal intensity is selected from a plurality of mass-to-charge ratios or MRM transitions related to the target compound concerned, and for a target compound having a comparatively low measurement target concentration or comparatively low measurement sensitivity, a mass-to-charge ratio or MRM transition which yields a comparatively high signal intensity is selected from a plurality of mass-to-charge ratios or MRM transitions related to the target compound concerned.

In a simultaneous multicomponent analysis in which the target compounds are previously known as mentioned earlier, the range of component concentrations to be measured (particularly, the upper limit of the range) is previously known for each compound. The measurement sensitivity, i.e. the signal intensity which will be obtained in a measurement for a compound contained at a specified concentration, can also be previously determined by an experimental measurement. Accordingly, it is easy to determine which compound has a comparatively high measurement target concentration or comparatively high measurement sensitivity among a large number of target compounds. Meanwhile, in many cases, there are a plurality of MRM transitions originating from one compound. Similarly, the mass-to-charge ratio for an SIM measurement often has a plurality of available values in the case of a mass spectrometer in which a fragmentation easily occurs in the ionization process, and particularly, in the case of a mass spectrometer including an ion source employing the electron ionization method which is commonly used in GC-MS. In such cases, it has conventionally been common practice that a mass-to-charge ratio or transition which yields the highest signal intensity (i.e. highest measurement sensitivity) is selected as the mass-to-charge ratio for the SIM measurement or the transition for the MRM measurement. By comparison, in the first mode of the method for a simultaneous multicomponent analysis according to the present invention, a mass-to-charge ratio or MRM transition which yields a comparatively low signal intensity is intentionally used in a measurement for a compound having a high measurement sensitivity or high measurement target concentration.

For example, in an MRM measurement, when the concentration of a target compound contained in the sample is high, the generated amount of product ions originating from that compound can be suppressed by selecting the transition in the previously described manner, whereby an entry of an excessive amount of ions into the detector will be prevented. The saturation of the signal in the detector can be thereby prevented. By comparison, for a compound whose measurement target concentration is originally low, such a suppression of the generated amount of product ions originating from the compound is not performed. Ions originating from a trace compound can efficiently enter the detector. Therefore, trace compounds can be detected with high sensitivity.

The second mode of the method for a simultaneous multicomponent analysis according to the present invention developed for solving the previously described problem is a method for a simultaneous multicomponent analysis in which an MRM measurement is performed for each of a plurality of known target compounds in a sample using a tandem mass spectrometer including two mass separators respectively located before and after a collision cell for dissociating ions, and the quantity of each of the compounds is determined based on the result of the measurement. In this mode of the method, the collision energy, which is one of the measurement conditions, is determined as follows: for a target compound having a comparatively high measurement target concentration or comparatively high measurement sensitivity, a level of collision energy which yields a lower dissociation efficiency than a level of collision energy which yields the highest dissociation efficiency for the target compound concerned is used, and for a target compound having a comparatively low measurement target concentration or comparatively low measurement sensitivity, the level of collision energy which yields the highest dissociation efficiency for the target compound concerned is used.

In a tandem mass spectrometer, a change in the collision energy causes a change in the ion dissociation efficiency, which causes a change in the amount of product ions reaching the detector. In the second mode of the method for a simultaneous multicomponent analysis, the generated amount of product ions is reduced by adjusting the level of collision energy, instead of intentionally selecting an MRM transition having a low measurement sensitivity in the first mode of the method for a simultaneous multicomponent analysis. The collision energy depends on the DC potential difference between the entrance end of the collision cell and the quadrupole mass filter or other ion optical systems placed on the front side of the same cell. Therefore, the collision energy can be adjusted, for example, by changing the DC bias voltages respectively applied to the ion optical system, front quadrupole mass filter and other elements located at the entrance end of the collision cell.

The third mode of the method for a simultaneous multicomponent analysis according to the present invention developed for solving the previously described problem is a method for a simultaneous multicomponent analysis in which an SIM measurement or MRM measurement is performed for each of a plurality of known target compounds in a sample using a mass spectrometer, and the quantity of each of the compounds is determined based on the result of the measurement. In this mode of the method, the mass-resolving power, which is one of the measurement conditions, is set at a higher level in a measurement for a target compound having a comparatively high measurement target concentration or comparatively high measurement sensitivity, than in a measurement for a target compound having a comparatively low measurement target concentration or comparatively low measurement sensitivity.

For example, in a quadrupole mass spectrometer or triple quadrupole mass spectrometer, when the mass-resolving power is increased by adjusting the voltages applied to the electrodes constituting a quadrupole mass filter, the mass-to-charge-ratio range within which ions can pass through the filter becomes narrower, which decreases the amount of ions and lowers the signal intensity. This phenomenon is utilized in the third mode of the method for a simultaneous multicomponent analysis, and the amount of ions reaching the detector is reduced by increasing the mass-resolving power, instead of intentionally selecting an MRM transition having a low measurement sensitivity in the first mode of the method for a simultaneous multicomponent analysis. In the case of a triple quadrupole mass spectrometer, the mass-resolving power may be increased in only one of the front and rear quadrupole mass filters, or both.

The fourth mode of the method for a simultaneous multicomponent analysis according to the present invention developed for solving the previously described problem is a method for a simultaneous multicomponent analysis in which an SIM measurement or MRM measurement is performed for each of a plurality of known target compounds in a sample using a mass spectrometer, and the quantity of each of the compounds is determined based on the result of the measurement. In this mode of the method, the detector gain, which is one of the measurement conditions, is set at a lower level in a measurement for a target compound having a comparatively high measurement target concentration or comparatively high measurement sensitivity, than in a measurement for a target compound having a comparatively low measurement target concentration or comparatively low measurement sensitivity.

In mass spectrometers, a detector including a conversion dynode combined with an electron multiplier having multistage dynodes is popularly used. In such a detector, the detector gain depends on the voltage applied to the detector. When the detector gain is lowered by decreasing the voltage applied to the detector, the detection signal for the same amount of incident ions decreases due to the decrease in the electron multiplication effect. This phenomenon is utilized in the fourth mode of the method for a simultaneous multicomponent analysis, and the detection signal is lowered by decreasing the gain of the detector, instead of intentionally selecting an MRM transition having a low measurement sensitivity in the first mode of the method for a simultaneous multicomponent analysis.

Needless to say, the first through fourth modes of the method for a simultaneous multicomponent analysis can be used in an appropriately combined form. For example, when the first and second modes are combined, it is possible to additionally lower the signal intensity by shifting the collision energy from the optimum value (which yields the highest measurement sensitivity) when the signal intensity is not sufficiently low even after the MRM transition has been changed to a transition having a low measurement sensitivity. By combining a plurality of methods, it becomes possible, for example, to avoid the saturation of the signal by sufficiently lowering the signal intensity for a compound whose measurement target concentration is extremely high.

A mass spectrometer according to the present invention is a tandem mass spectrometer for the first through fourth modes of the method for a simultaneous multicomponent analysis, including:

a compound-related information storage section for storing, for each of all target compounds, an MRM transition to be monitored in an MRM measurement as well as at least one measurement condition selected from the collision energy, the mass-resolving power and the detector gain, or a parameter which determines the measurement condition; and a control sequence creator for creating a control sequence used for performing a simultaneous multicomponent analysis, using information stored in the compound-related information storage section, where the information stored in the compound-related information storage section is prepared in such a manner that a value of the measurement condition which yields a measurement sensitivity lower than the highest measurement sensitivity, or a value of the parameter which determines the value of the measurement condition, is stored for a target compound having a comparatively high measurement target concentration or comparatively high measurement sensitivity, where the measurement condition is selected from the MRM transition, the collision energy, the mass-resolving power and the detector gain.

The information stored in the compound-related information storage section may be determined by preliminary experiments or similar tasks performed by a user who performs a measurement using the present device or by a manufacturer of the present device. In the case of the testing of residual agricultural chemicals or similar tasks mentioned earlier, the target compounds are entirely specified in the Positive List based on the related laws or the like and are therefore common to all users. Therefore, manufacturers can obtain information prepared for a specific purpose and provide it for users.

Advantageous Effects of the Invention

With the method for a simultaneous multicomponent analysis and the mass spectrometer according to the present invention, it is possible to perform a high-sensitivity measurement for trace compounds while preventing the saturation of the signal for high-concentration compounds even when the target compounds significantly vary in measurement target concentration and/or yield significantly different levels of signal intensity. Since it is unnecessary to divide a large number of compounds into groups and perform a measurement for each group as in a conventional method, the amount of sample used for the measurement will be decreased. In the case of the mass spectrometer having a GC or LC connected to its front end, the consumption of the mobile phase used in the GC or LC will also be reduced. The measurement time will also be shortened. Thus, the measurement cost will be lowered.

DESCRIPTION OF EMBODIMENTS

One embodiment of the method for a simultaneous multicomponent analysis as well as a mass spectrometer for carrying out the same method are hereinafter described in detail with reference to the attached drawings.

Figure 1:
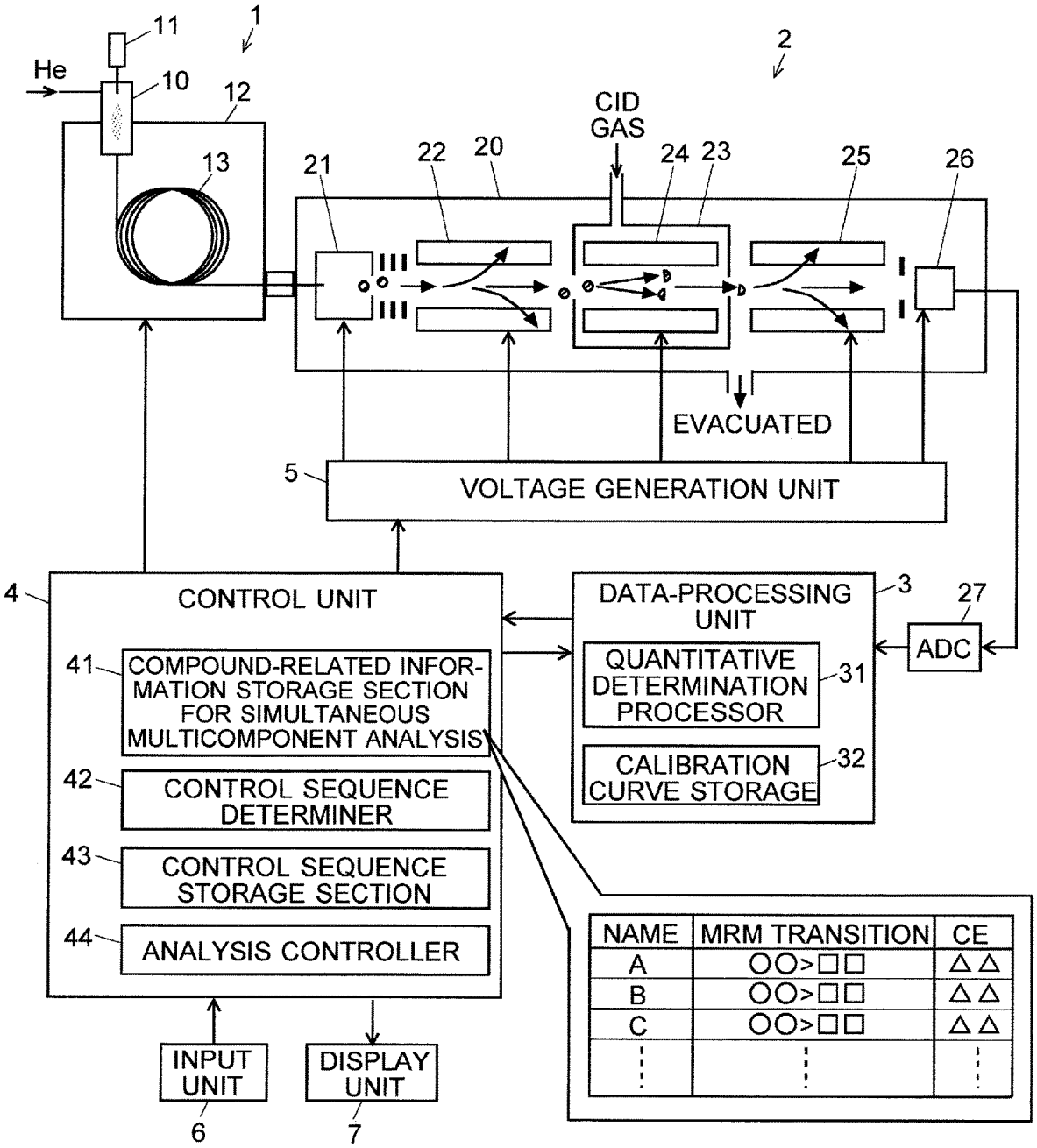
FIG. 1 is a schematic configuration diagram of one embodiment of a GC-MS for carrying out the method for a simultaneous multicomponent analysis according to the present invention.

FIG. 1 is a schematic configuration diagram of one embodiment of a gas chromatograph mass spectrometer (GC-MS) including a mass spectrometer for carrying out the method for a simultaneous multicomponent analysis according to the present invention.

This GC-MS includes a gas chromatograph 1, mass spectrometer 2, data-processing unit 3, control unit 4, voltage generation unit 5, input unit 6 and display unit 7. The gas chromatograph 1 includes: a sample vaporization chamber 10 for vaporing a trace amount of liquid sample; a micro syringe 11 for injecting the liquid sample into the sample vaporization chamber 10; a column 13 for temporally separating compounds in the sample; and a column oven 12 for controlling the temperature of the column 13. The mass spectrometer 2 includes an analysis chamber 20 evacuated by a vacuum pump (not shown). This chamber contains: an ion source 21 for ionizing a target compound by electron ionization or a similar ionization method; a front quadrupole mass filter 22 formed by four rod electrodes; a collision cell 23 containing an ion guide 24 for transporting ions while converging them; a rear quadrupole mass filter 25 having the same electrode structure as the front quadrupole mass filter 22; and a detector 26 for producing, as a detection signal, an ion intensity signal corresponding to the amount of incident ions. For example, the detector 26 includes a conversion dynode combined with an electron multiplier.

The detection signal generated by the detector 26 is converted into digital data by an analogue-to-digital converter (ADC) 27 and sent to the data-processing unit 3. The data-processing unit 3 includes a quantitative determination processor 31 and a calibration curve storage section 32 as its functional blocks. The quantitative determination processor 31 quantitatively determines the concentration of each of a large number of target compounds contained in a sample, using a calibration curve previously stored in the calibration curve storage section 32. The control unit 4 is responsible for controlling the gas chromatograph 1, voltage generation unit 5 and other related units. It includes a compound-related information storage section 41 for simultaneous multicomponent analysis, control sequence determiner 42, control sequence storage section 43, analysis controller 44 and other functional blocks. Additionally, the control unit 4 provides a user interface through the input unit 6 and the display unit 7, as well as acts as a general controller for the entire system. The voltage generation unit 5 operates under the command of the control unit 4 and applies predetermined voltages to the ion source 21, quadrupole mass filters 22 and 25, ion guide 44, detector 26 as well as other related components in the mass spectrometer 2, respectively.

The data-processing unit 3 and the control unit 4 can be constructed using a personal computer or more sophisticated workstation as a hardware resource, with their respective functions realized by executing, on the computer, a dedicated controlling and processing software program previously installed on the same computer. In this case, the input unit 6 includes a keyboard and a pointing device (e.g. mouse) provided along with the computer. The display unit 7 is a display monitor of the computer.

A basic operation in the GC-MS shown in FIG. 1 is hereinafter schematically described.

A trace amount of liquid sample is dropped from the micro syringe 11 into the sample vaporization chamber 10. The liquid sample is quickly vaporized within the sample vaporization chamber 10. The various components in the sample are carried by a stream of carrier gas, such as helium, and sent into the column 13. While passing through the column 13, each substance in the sample is delayed by a different amount of time and reaches the exit port of the column 13. The column oven 12 is controlled to maintain a substantially constant temperature or increase its temperature according to a predetermined temperature profile. The ion source 21 in the mass spectrometer 2 sequentially ionizes target compounds contained in the gas supplied from the exit port of the column 13.

The analysis controller 44 controls the voltage generation unit 5 so that a voltage which allows an ion having a specific mass-to-charge ratio to pass through is applied to each rod electrode of the front quadrupole mass filter 22 according to a control sequence stored in the control sequence storage section 43. As a result, an ion having a specific mass-to-charge ratio among the various kinds of ions derived from the target compound introduced into the ion source 21 is allowed to pass through the front quadrupole mass filter 22 and be introduced into the collision cell 23 as a precursor ion. Meanwhile, collision induced dissociation (CID) gas is continuously or intermittently introduced into the collision cell 23. The precursor ion comes in contact with this gas and undergoes fragmentation, whereby various product ions are generated. The analysis controller 44 also applies, through the voltage generation unit 5 to each rod electrode of the rear quadrupole mass filter 25, a voltage which allows an ion having a specific mass-to-charge ratio to pass through the filter. As a result, an ion having a specific mass-to-charge ratio among the various product ions generated within the collision cell 23 is allowed to pass through the rear quadrupole mass filter 25 and reach the detector 26. A detection signal corresponding to the amount of ions is converted into digital data and fed to the data-processing unit 3.

Based on the data which are sequentially fed (or temporarily stored in a data storage section, which is not shown), the quantitative determination processor 31 creates a mass chromatogram for each target compound over a period of time around the point in time at which the compound appears. Then, the same processor detects a peak corresponding to the target compound in the mass chromatogram, calculates the peak area, and computes the concentration value, or the quantitative value, with reference to the calibration curve showing the relationship between the peak-area value and the concentration. This curve is previously stored in the calibration curve storage section 32.

Figure 2:
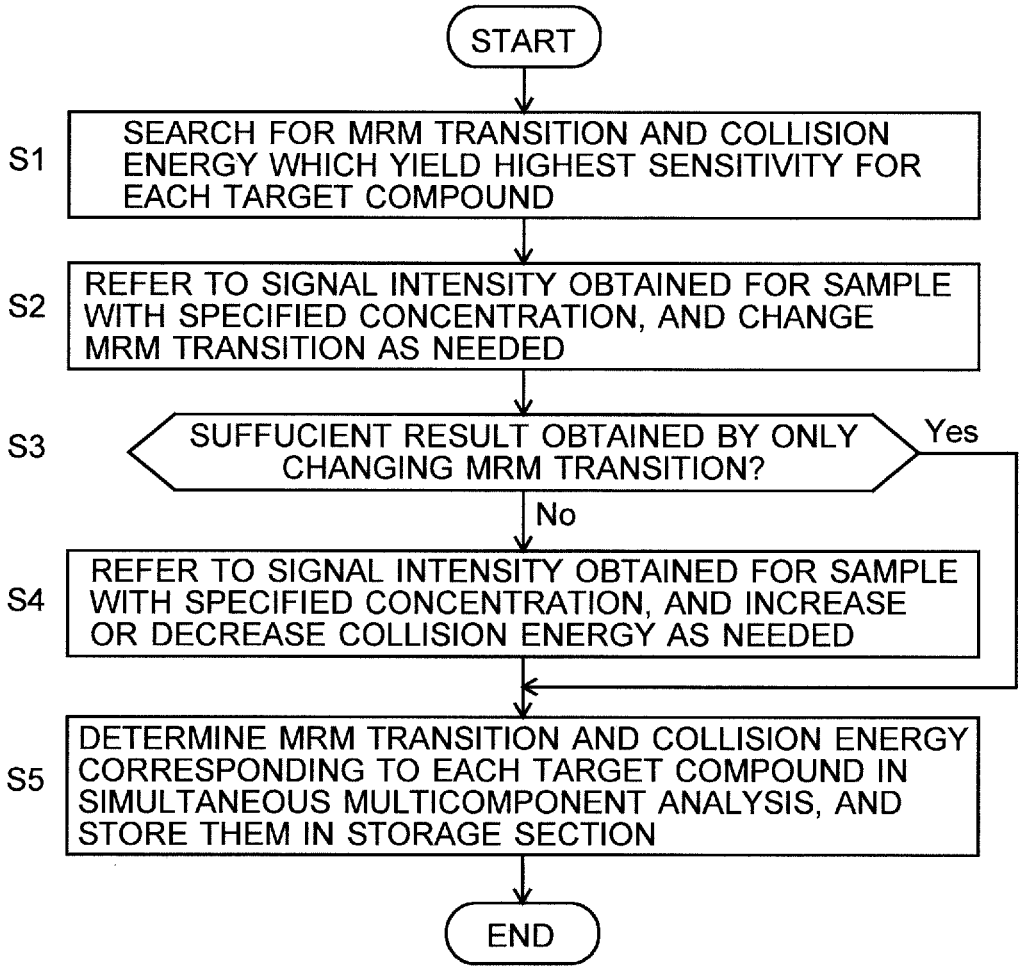
FIG. 2 is a flowchart showing the steps of the tasks and processes for obtaining information to be stored in the compound-related information storage section in the GC-MS in the present embodiment.

An operation for a simultaneous multicomponent analysis using the GC-MS in the present embodiment for target compounds which are entirely known beforehand is hereinafter described. FIG. 2 is a flowchart showing the steps of the tasks and processes for obtaining information to be stored in the compound-related information storage section in the present GC-MS.

An example of the simultaneous multicomponent analysis imagined in the following description is the testing of residual agricultural chemicals in foods according to the Positive List. In that case, the kinds of target compounds are entirely known beforehand. Therefore, commonly known compound databases can be used to obtain necessary items of information, such as the MRM transition (i.e. the combination of the mass-to-charge ratio of a precursor ion and that of a product ion to be detected originating from the target compound) and the retention time under specific GC separation conditions. Accordingly, all product ions originating from the target compounds can be detected in the mass spectrometer 2 without omission by performing, for each compound, an MRM measurement in which the specified MRM transition is monitored over the specified range of measurement time around the retention time for the compound.

However, in normal situations, there are a plurality of MRM transitions for one compound. The more complex the compound structure is, the larger the number of MRM transitions becomes. Furthermore, in the case of using an ion source which employs electron ionization, the number of MRM transitions tends to be even greater since a fragmentation occurs in the ionization process and a plurality of kinds of precursor ions are produced from one compound.

Figure 3A:
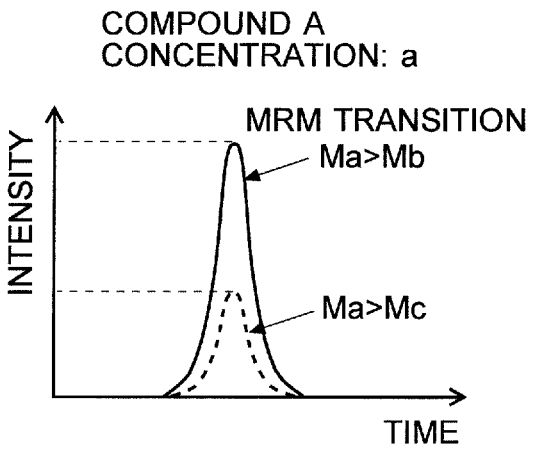
FIGS. 3A and 3B are model diagrams showing mass chromatograms of product ions originating from two compounds A and B contained at the same concentration.
Figure 3B:
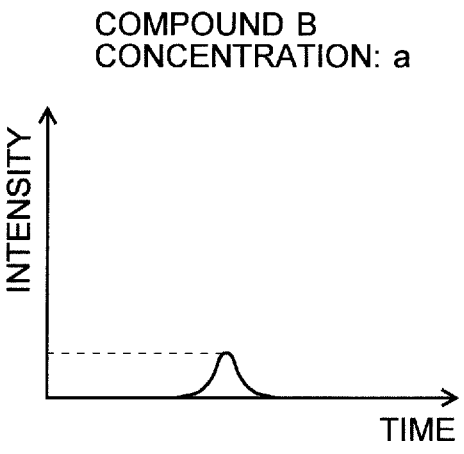

When a plurality of kinds of product ions are generated by the dissociation of a precursor ion, the dissociation efficiency varies from ion to ion, so that the resulting signal intensity changes depending on the MRM transition. FIGS. 3A and 3B are model diagrams showing mass chromatograms for product ions originating from two compounds A and B contained at the same concentration. For compound A shown in FIG. 3A, there are at least two MRM transitions (in the present example, each MRM transition includes the same precursor ion, i.e. m/z=Ma, and a different product ion, i.e. m/z=Mb or Mc). The two MRM transitions yield significantly different ion intensities. As for compound B shown in FIG. 3B, the ion intensity is lower than the highest ion intensity for the two MRM transitions mentioned in the case of compound A. Thus, various target compounds need be considered in a simultaneous multicomponent analysis, and a significant difference in the signal intensity of the product ions, i.e. the measurement sensitivity, may occur even when the concentrations of the compounds are the same. Furthermore, the concentrations of the target compounds are not always the same; in a simultaneous multicomponent analysis for the testing of residual agricultural chemicals, the testing of contaminants or similar purposes, the concentration range to be measured may significantly vary from one compound to another since the regulation value considerably varies depending on the kind of target compound.

In order to enable an accurate quantitative determination for a trace compound while avoiding the saturation of the detection signal obtained with the detector 26 even when the measurement sensitivity or measurement target concentration varies depending on the target compound, a characteristic analyzing method is adopted in the GC-MS in the present embodiment, as will be hereinafter described.

Specifically, for each compound among all target compounds to be analyzed in a simultaneous multicomponent analysis, an appropriate MRM transition and collision-energy level are previously determined and stored in the compound-related information storage section 41 for simultaneous multicomponent analysis. A procedure for determining the appropriate MRM transition and collision-energy level for each target compound is hereinafter described with reference to FIG. 2.

For the present description, it is assumed that a plurality of MRM transitions are known for each target compound, but which of those MRM transitions yields the highest signal intensity is unknown. In that case, a standard sample which contains one target compound at a known concentration is introduced into the mass spectrometer 2, and a series of MRM measurements in which the known MRM transitions corresponding to the compound are sequentially set are performed to find an MRM transition which yields the highest signal intensity of the product ions. Subsequently, with the MRM transition fixed at the MRM transition which yields the highest signal intensity, the DC bias voltages applied from the voltage generation unit 5 to the electrodes or similar elements provided in the front quadrupole mass filter 22 or at the entrance of the collision cell 23 are changed so as to sequentially set the collision energy at a plurality of levels. The signal intensity of the product ion is determined at each of the different levels of collision energy to find a collision-energy level which yields the highest signal intensity. Such a search for the MRM transition and the collision-energy level which yield the highest signal intensity is performed for each of all target compounds in the simultaneous multicomponent analysis (Step S1). An automatic tuning software product disclosed in Non Patent Literature 1 can be used for such a search for the measurement conditions. If the MRM transition which gives the highest signal intensity is previously known, only the search for the collision-energy level needs to be performed, and the first half of Step S1 may be omitted.

The MRM transition and the collision-energy level obtained for each target compound in Step S1 have been determined under the simple condition that the signal intensity should be maximized. As the next step, for each target compound, a sample which contains the compound at a concentration corresponding to the concentration range to be measured is introduced into the mass spectrometer 2. Then, an MRM measurement under the measurement conditions determined in Step S1 is performed, and the signal intensity of the product ion is examined. The signal intensities of the product ions determined for different target compounds are compared with each other. If there is a compound for which an extremely high signal intensity has been obtained, an MRM measurement in which another MRM transition related to that compound is set is performed, and the signal intensity under that MRM transition is examined. Then, for a target compound which yields a comparatively high signal intensity, the MRM transition related to that compound is changed by selecting the MRM transition which yields the lower signal intensity in place of the MRM transition which yields the highest signal intensity (Step S2).

Subsequently, whether or not the signal intensity has been sufficiently suppressed by the change of the MRM transition in Step S2 is determined (Step S3). For a compound for which the signal intensity has not been sufficiently suppressed, the process of Step S4 is performed as follows: The aforementioned sample which contains the compound at a concentration corresponding to the concentration range to be measured is introduced into the mass spectrometer 2, and an MRM measurement in which the collision-energy level is increased or decreased from the optimum level (which yields the highest signal intensity) related to the compound concerned is performed. The change in the collision-energy level from the optimum level lowers the dissociating efficiency of the precursor ion within the collision cell 23, and consequently, the signal intensity of the product ions decreases. Accordingly, the collision-energy level is changed until the signal intensity is decreased to a sufficiently low level to determine an appropriate collision-energy level for the target compound concerned (Step S4).

After the appropriate MRM transitions and the collision-energy levels for all target compounds in the simultaneous multicomponent analysis have been determined through the procedure of Steps S1-S4, the result is stored, for example, in a tabular form as shown in FIG. 1 in the compound-related information storage section 41 for simultaneous multicomponent analysis (Step S5). The information stored in the compound-related information storage section 41 for simultaneous multicomponent analysis can be considered as a set of appropriate MRM transitions and collision-energy levels that have been determined taking into account the difference in the measurement sensitivity for each compound, the difference in the concentration range to be measured in the simultaneous multicomponent analysis, and other factors. Those data are naturally different from the MRM transitions and collision-energy levels that have been determined to maximize signal intensities.

Figure 4:
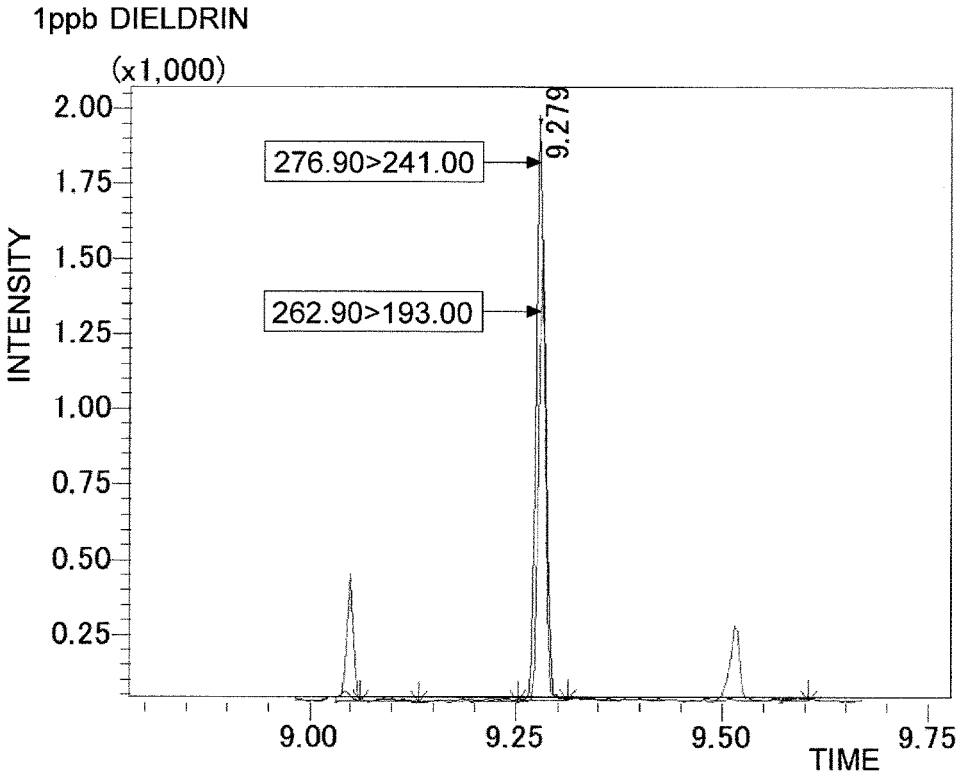
FIG. 4 is a diagram showing a mass chromatogram obtained by a measurement for a sample with a dieldrin concentration of 1 ppb.
Figure 5:
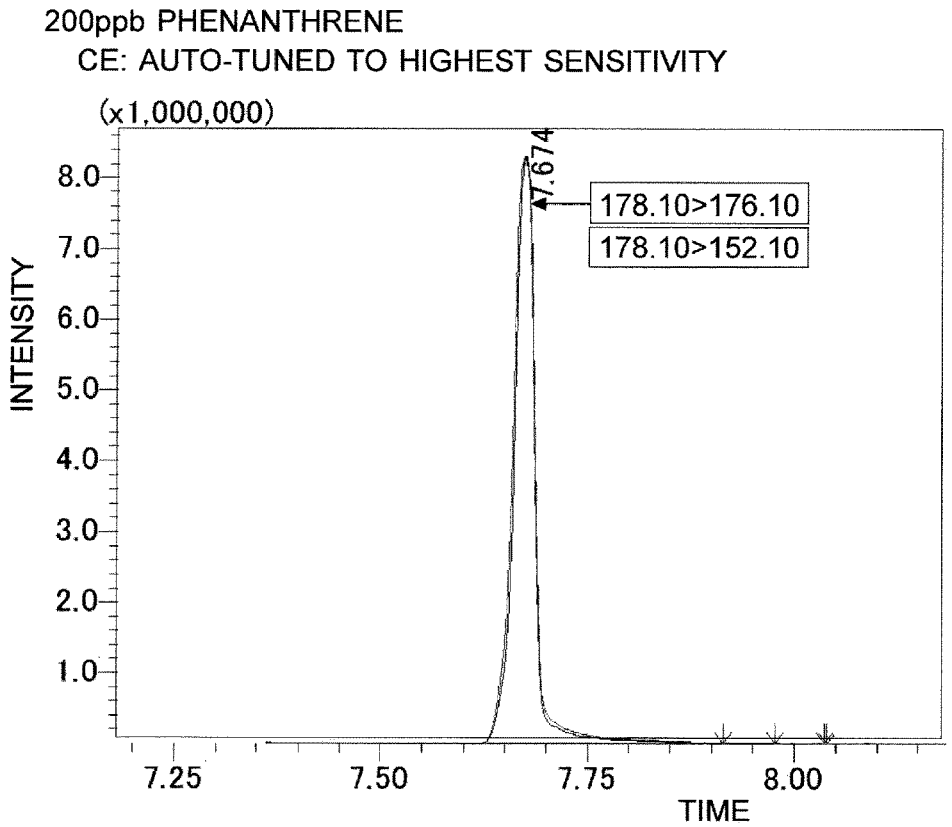
FIG. 5 is a diagram showing a mass chromatogram obtained by a measurement for a sample with a phenanthrene concentration of 200 ppb.

FIGS. 4-8 are measured mass chromatograms. Specifically, FIG. 4 shows the result of a measurement for a sample with a dieldrin concentration of 1 ppb, while FIGS. 5-8 each show the result of a measurement for a sample with a phenanthrene concentration of 200 ppb. FIG. 5 shows the result obtained by a measurement in which the collision energy was set at an optimum level by automatic tuning. The vertical axis (intensity axis) in FIG. 5 corresponds to 1000 times the vertical axis in FIG. 4. The signal-intensity difference between dieldrin and phenanthrene used in the measurements is far larger than their concentration difference, which is 200 times. It can also be seen that the measurement sensitivity for phenanthrene is higher. To avoid the saturation of the signal for the aforementioned concentration of phenanthrene without causing a decrease in the signal intensity for the aforementioned concentration of dieldrin, it is necessary to change the conditions of the MRM measurement for phenanthrene.

Figure 7:
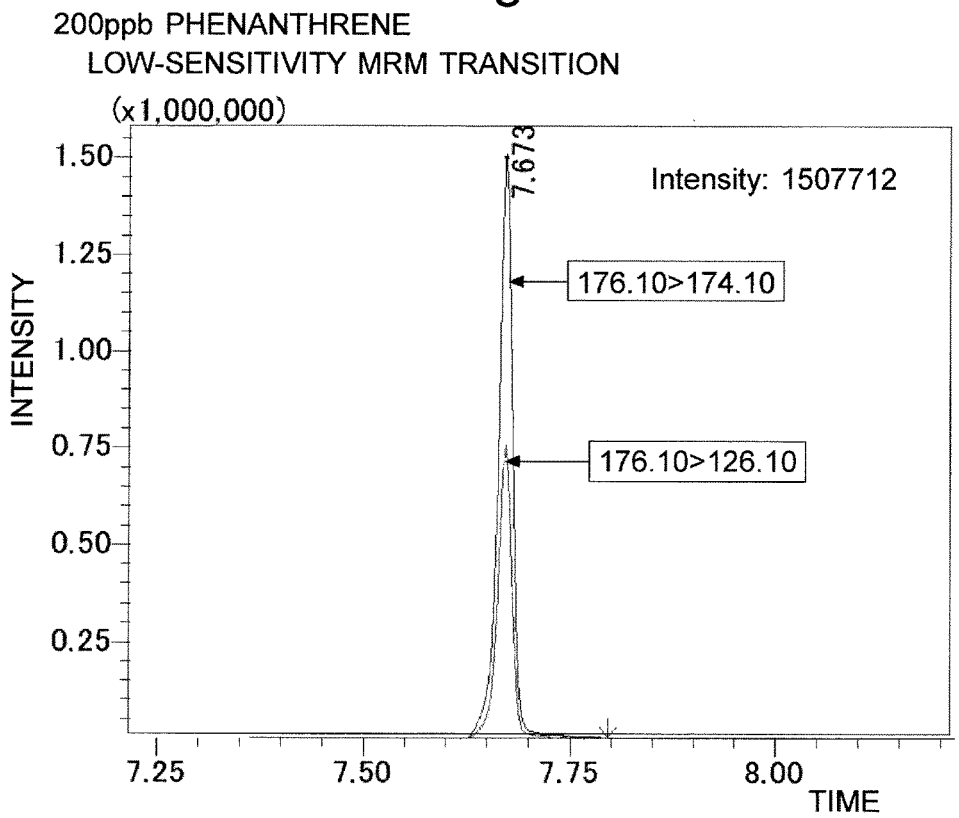
FIG. 7 is a diagram showing a mass chromatogram obtained by a measurement for a sample with a phenanthrene concentration of 200 ppb.
Figure 8:
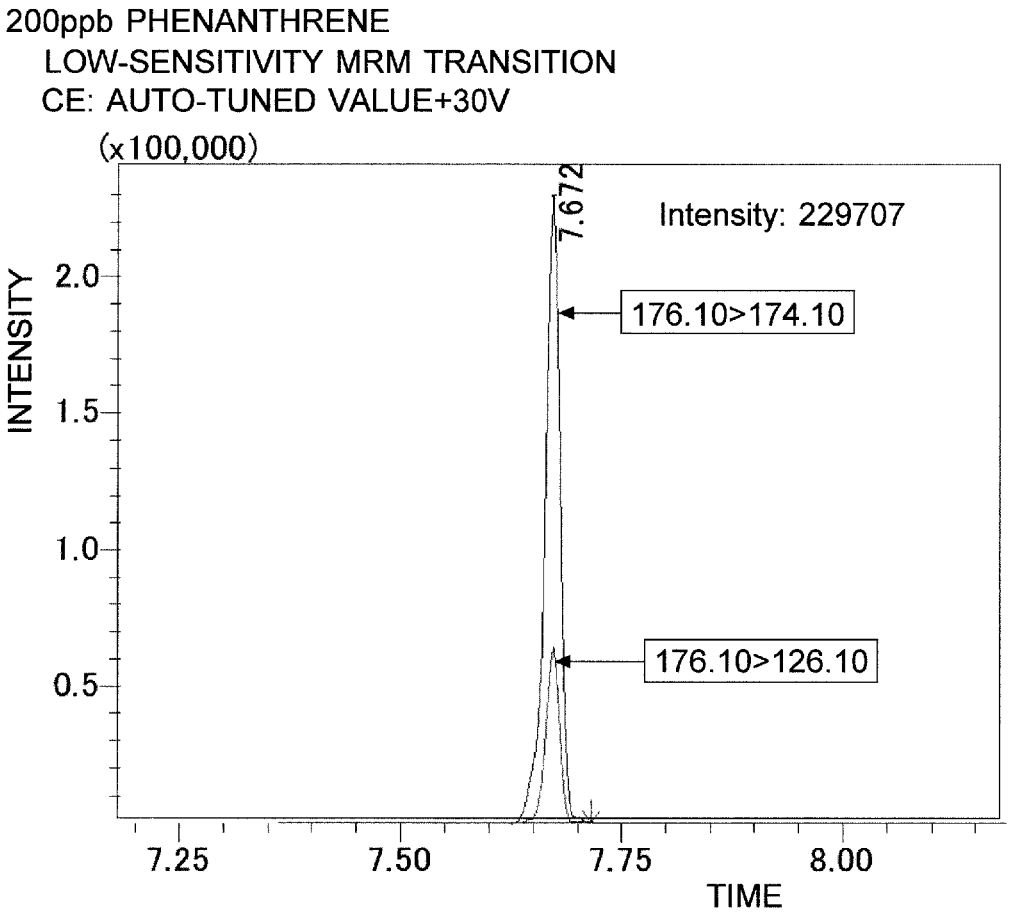
FIG. 8 is a diagram showing a mass chromatogram obtained by a measurement for a sample with a phenanthrene concentration of 200 ppb.

FIG. 7 shows the result obtained by an MRM measurement for phenanthrene in which an MRM transition different from the one shown in FIG. 5 was set. The signal intensity obtained with an MRM transition expressed as "m/z 178.10>126.10", which yields the lowest signal intensity, is decreased to a level equal to or lower than 1/10 of the signal intensity obtained with an MRM transition expressed as "m/z 178.10>176.10" which yields the highest signal intensity. However, since the signal intensity is still considerably high, the signal intensity in this case should be further decreased by adjusting the collision-energy level. FIG. 8 shows the result obtained by an MRM measurement in which the collision energy was increased from the optimum level by 30 V after the low-sensitivity MRM transition mentioned earlier was selected. With the increase in the collision-energy level, the signal intensity has further decreased to a level equal to or lower than 1/10 of the previous level. In other words, the signal intensity has been decreased to a level equal to or lower than 1/100 of the highest level by combining the selection of the appropriate MRM transition and the adjustment of the collision-energy level.

Figure 6:
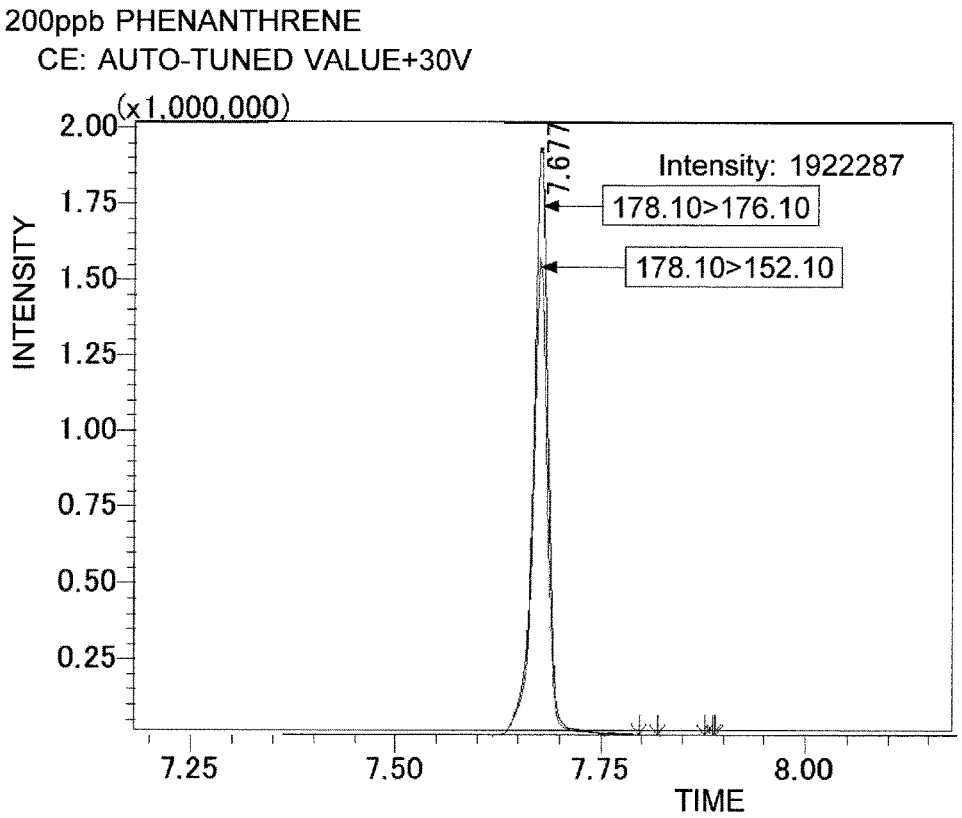
FIG. 6 is a diagram showing a mass chromatogram obtained by a measurement for a sample with a phenanthrene concentration of 200 ppb.

FIG. 6 shows the result obtained by an MRM measurement in which the collision-energy level was increased by +30 V without changing the MRM transition from the one shown FIG. 5. This result demonstrates that the signal intensity could not be sufficiently decreased by solely adjusting the collision-energy level.

As just described, in the example of FIGS. 4-8, a sufficient decrease in the signal intensity as compared to the signal intensity obtained under the optimum MRM transition and collision-energy level could be achieved by combining the selection of a low-sensitivity MRM transition and the adjustment of the collision-energy level. By this operation, the possibility of the saturation of the detection signal can be eliminated even when the concentration range to be measured is particularly wide (in particular, when the upper limit of the concentration to be measured is high), and the dynamic range of the concentration to be measured can be widened. Needless to say, if the concentration to be measured is not very high, it may be possible to solely perform the selection of a low-sensitivity MRM transition and omit the adjustment of the collision-energy level.

The information of the MRM transitions and collision-energy levels stored in the storage section 41 can be used in the process of preparing a control sequence (measurement method) for carrying out the simultaneous multicomponent analysis. That is to say, the control sequence determiner 42 prepares a control sequence for repeatedly performing an MRM measurement of each target compound under the measurement conditions including the MRM transition and collision-energy level stored in the storage section 41 within a specified period of time around the retention time at which the compound concerned appears. If the number of target compounds is large, those compounds cannot be fully separated from each other by the column 13 in the gas chromatograph 1, and therefore, it is necessary to perform MRM measurements for different target compounds within a certain time range. In such a case, the control sequence can be prepared so as to determine the temporal change in the signal intensity for each target compound by repeating a cycle in which a set of MRM measurements for different target compounds with overlapped ranges of measurement time are individually and sequentially performed in such a manner that one MRM measurement for one target compound is performed for a predetermined period of time, followed by another MRM measurement for another target compound performed for a predetermined period of time, and so on.

The task of obtaining appropriate information by the procedure shown in FIG. 2 may be performed by a user who performs simultaneous multicomponent analyses using the present device. However, as in the testing of residual agricultural chemicals according to the Positive List, if the kinds of target compounds and the concentration ranges to be measured for those compounds are previously specified independently of the user, it is more convenient to make the device manufacturer or similar organization perform the task. In that case, in place of or in addition to the information in a tabular form as shown in FIG. 1 stored in the compound-related information storage section 41 for simultaneous multicomponent analysis, the necessary data may be provided as a portion of a controlling and processing software product for simultaneous multicomponent analysis.

In the previously described embodiment, the signal intensity of a specific target compound is suppressed by initially changing the MRM transition and additionally changing the collision-energy level as needed. It is also possible to solely change the collusion-energy level without changing the MRM transition. A measurement condition other than the MRM transition and collision-energy level may also be changed for each compound to suppress the signal intensity.

Specifically, in the front quadrupole mass filter 22, the mass-to-charge ratio of the ion to be allowed to pass through the filter 22 is controlled by adjusting the radio-frequency voltage and the direct-current voltage applied to the four rod electrodes constituting the filter 22. The mass-resolving power of the filter 22 for allowing the passage of an ion (precursor ion) depends on the stability condition for the ions within the quadrupole electric field created within the space surrounded by the four rod electrodes, i.e. on the voltages applied to those electrodes. Similarly, the mass-resolving power of the rear quadrupole mass filter 25 for allowing the passage of an ion (product ion) depends on the voltages applied to the electrodes constituting the filter 25. Improving the mass-resolving power causes the peak on the mass spectrum to be smaller in width (i.e. higher in resolution) and lower in peak intensity. Accordingly, it is possible to decrease the signal intensity of the product ion by adjusting the voltage applied to one or both of the front and rear quadrupole mass filters 22 and 25 so as to improve their mass-resolving power. Based on this fact, the mass-resolving power for a compound having a high measurement sensitivity or a compound having a high measurement target concentration may be set at a higher level than for other compounds.

As noted earlier, the combination of a conversion dynode and an electron multiplier is commonly used as the detector 26. The gain of such a detector 26 depends on the voltage applied to the detector 26. Decreasing the gain of the detector 26 lowers the detection signal for the same amount of incident ions. Therefore, the saturation of the detection signal due to an incidence of a large amount of ions can be thereby prevented. Thus, as with the MRM transition or collision-energy level described earlier, other measurement parameters, such as the mass-resolving power, detector gain, or voltage values which determine them, may be related to each of all target compounds, and a condition which yields a low signal intensity for a compound having a high measurement sensitivity or a compound having a high measurement target concentration may be stored beforehand to perform a satisfactory simultaneous multicomponent analysis.

Although the mass spectrometer 2 in the previous embodiment is a triple quadrupole mass spectrometer, it is evident that the present invention is also applicable in a Q-TOF mass spectrometer in which a time-of-flight mass separator is used in place of the rear quadrupole mass filter 25. In the case of a single-type mass spectrometer, such as a quadrupole mass spectrometer which is not a tandem quadrupole mass spectrometer, although no collision-energy level is present, the present invention can be applied in determining the mass-to-charge ratio to be monitored in the SIM measurement in place of the MRM transition.

Furthermore, in the previous embodiment, the gas chromatograph 1 is connected to the front end of the mass spectrometer 2. A liquid chromatograph may also be similarly connected. The present invention can also be applied in a system to which no chromatograph is connected. One example is a mass spectrometer including an ion source which employs the so-called ambient ionization, such as the DART ion source. In this device, although most of the plurality of target compounds contained in a sample are introduced in a temporally overlapped form, the quantity of each target compound can be determined from a graph which shows the temporal change of the signal intensity for each compound. Therefore, the method for a simultaneous multicomponent analysis according to the present invention is useful.

The previously described embodiment and variations are mere examples of the present invention. Any change, modification or addition appropriately made within the spirit of the present invention will evidently fall within the scope of claims of the present application.

REFERENCE SIGNS LIST

1 . . . Gas Chromatograph
10 . . . Sample Vaporization Chamber
11 . . . Micro Syringe
12 . . . Column Oven
13 . . . Column
2 . . . Mass Spectrometer
20 . . . Analysis Chamber
21 . . . Ion Source
22 . . . Front Quadrupole Mass Filter
23 . . . Collision Cell
24 . . . Ion Guide
25 . . . Rear Quadrupole Mass Filter
26 . . . Detector
27 . . . Analogue-to-Digital Converter
3 . . . Data-Processing Unit
31 . . . Quantitative Determination Processor
32 . . . Calibration Curve Storage Section
4 . . . Control Unit
41 . . . Compound-Related Information Storage Section for Simultaneous Multicomponent Analysis
42 . . . Control Sequence Determiner
43 . . . Control Sequence Storage Section
44 . . . Analysis Controller
5 . . . Voltage Generation Unit
6 . . . Input Unit
7 . . . Display Unit

The invention claimed is:

1. A method for a simultaneous multicomponent analysis in which an MRM (multiple reaction measurement) measurement is performed for each of a plurality of known target compounds in a sample using a tandem mass spectrometer including two mass separators respectively located before and after a collision cell for dissociating ions, and a quantity of each of the compounds is determined based on a result of the measurement, wherein:

a collision energy, which is one of measurement conditions, is determined as follows: for a target compound having a comparatively high measurement target concentration or comparatively high measurement sensitivity, a level of collision energy which yields a lower dissociation efficiency than a level of collision energy which yields a highest dissociation efficiency for the target compound concerned is used, and for a target compound having a comparatively low measurement target concentration or comparatively low measurement sensitivity, the level of collision energy which yields the highest dissociation efficiency for the target compound concerned is used.

2. A tandem mass spectrometer used for the method for a simultaneous multicomponent analysis according to claim 1, comprising:

a compound-related information storage section for storing, for each of all target compounds, an MRM transition to be monitored in an MRM measurement as well as the collision energy or a parameter which determines the collision energy; and a control sequence creator for creating a control sequence used for performing a simultaneous multicomponent analysis, using information stored in the compound-related information storage section, where the information stored in the compound-related information storage section is prepared in such a manner that a value of either the collision energy or the parameter which determines the collision energy which yields a measurement sensitivity lower than a highest measurement sensitivity is stored for a target compound having a comparatively high measurement target concentration or comparatively high measurement sensitivity.

* * * * *